US007866271B2

(12) United States Patent
Wrage et al.

(10) Patent No.: US 7,866,271 B2
(45) Date of Patent: Jan. 11, 2011

(54) PLACEMENT SYSTEM FOR A FLYING KITE-TYPE WIND-ATTACKED ELEMENT IN A WIND-POWERED WATERCRAFT

(75) Inventors: Stephan Wrage, Hamburg (DE); Johannes Böhm, Kaarst (DE)

(73) Assignee: Skysails GmbH & Co. KG, Hamburg (DE)

( * ) Notice: Subject to any disclaimer, the term of this patent is extended or adjusted under 35 U.S.C. 154(b) by 0 days.

(21) Appl. No.: 12/387,255

(22) Filed: Apr. 30, 2009

(65) Prior Publication Data

US 2009/0266283 A1 Oct. 29, 2009

Related U.S. Application Data

(63) Continuation-in-part of application No. 11/578,860, filed as application No. PCT/EP2005/004186 on Apr. 19, 2005, now abandoned.

(30) Foreign Application Priority Data

Apr. 19, 2004 (DE) ..... 10 2004 018 814

(51) Int. Cl.
*B63H 9/04* (2006.01)

(52) U.S. Cl. ..... 114/102.16; 114/102.29; 114/102.1

(58) Field of Classification Search ..... 114/102.1, 114/102.15, 102.16, 102.18, 102.2, 102.29, 114/39.11, 39.21–39.32, 104, 105; 244/155 A, 244/242, 249, 253, 254, 115, 116, 123.11; 701/21

See application file for complete search history.

(56) References Cited

U.S. PATENT DOCUMENTS 2,433,344 A 12/1947 Crosby
3,180,090 A 4/1965 Hawley et al.

(Continued)

FOREIGN PATENT DOCUMENTS

DE 3817 073 A1 12/1988

(Continued)

OTHER PUBLICATIONS

J.F. Wellicome et al, "Ship Propulsive Kites- An Initial Study,"*University of Southampton*, ISSN 01403818 SSSU 19, pp. i-71.

*Primary Examiner*—Ed Swinehart
(74) *Attorney, Agent, or Firm*—Alix, Yale & Ristas, LLP

(57) ABSTRACT

Disclosed is a placement system for a free-flying kite-type wind-attacked element in a watercraft in which the kite-type wind-attacked element comprising a profiled wing is connected to the vessel body via a traction rope. Said wind-attacked element can be guided from a neutral position on board the watercraft into a raised position that is free from obstacles located at the same or a higher level. An azimuthally pivotable fixture is provided by means of which the wind-attacked element can be brought into a position in which the same is exposed to a sufficient wind effect. Furthermore, a docking receiving device is provided which is to be removably connected to the docking adapter of the wind-attacked element on the side facing away from the wind while also allowing the wind-attacked element to be furled with the aid of automatically engaging holding means.

29 Claims, 14 Drawing Sheets

U.S. PATENT DOCUMENTS

| | | | | | |
|---|---|---|---|---|---|
| 3,521,836 | A | | 7/1970 | Struble, Jr. | |
| 3,606,713 | A | * | 9/1971 | Runquist | 52/115 |
| 3,987,746 | A | | 10/1976 | McCulloh | |
| 4,102,291 | A | | 7/1978 | Sebald | |
| 4,421,286 | A | * | 12/1983 | Laky et al. | 244/116 |
| 4,497,272 | A | | 2/1985 | Veazey | |
| 5,244,169 | A | * | 9/1993 | Brown et al. | 244/146 |
| 5,271,351 | A | | 12/1993 | Horiuchi et al. | |
| 5,355,817 | A | | 10/1994 | Schrems | |
| 5,642,683 | A | | 7/1997 | Bedford | |
| 6,254,034 | B1 | | 7/2001 | Carpenter | |
| 6,616,402 | B2 | | 9/2003 | Selsam | |
| 6,918,346 | B2 | | 7/2005 | Grenier | |
| 2002/0139603 | A1 | | 10/2002 | Aiken et al. | |
| 2003/0140835 | A1 | | 7/2003 | Wrage | |

FOREIGN PATENT DOCUMENTS

| | | | |
|---|---|---|---|
| FR | 2 781 195 | A | 1/2000 |
| GB | 2 098 946 | A | 12/1982 |
| GB | 2 098 950 | A | 12/1982 |
| GB | 2 098 952 | A | 12/1982 |
| GB | 2 294 666 | A | 5/1996 |
| WO | WO02/079030 | A1 | 10/2002 |
| WO | WO 03/097448 | | 11/2003 |

* cited by examiner

PLACEMENT SYSTEM FOR A FLYING KITE-TYPE WIND-ATTACKED ELEMENT IN A WIND-POWERED WATERCRAFT

RELATED APPLICATION

This application is a continuation-in-part of, and claims the benefit of, U.S. application Ser. No. 11/578,860 filed Oct. 19, 2006 now abandoned for Placement System For A Flying Kite-Type Wind-Attacked Element In A Wind-Powered Watercraft, which is the National Stage of International Application PCT/EP2005/004186 filed Apr. 19, 2005. Priority is claimed under 35 USC 119(a) from German Patent Application 102004018814.9 filed Apr. 19, 2004.

BACKGROUND OF THE INVENTION

The invention relates to a system for deployment of a freely flying kite-like element on which wind acts, for a watercraft with wind propulsion.

A deployment system such as this for a freely flying kite-like element on which wind acts is known from the document: Ship Propulsive Kites, An Initial Study, by J. F. Wellicome and S. Williams, University of Southampton, ISSN 0140 3818 SSSU19, Section 4.1.2 "Non Powered Drogue Launch".

This deployment system, which is indicated only in the form of a sketch in the cited publication and has not been fully developed, has the disadvantage that an auxiliary drive in the form of an additional parachute is required for deployment of the element on which wind acts. Furthermore, no measures are evident to allow a relatively large element on which wind acts also to be stowed safely again.

SUMMARY OF THE DISCLOSURE

Measures for a deployment system make it possible to launch a system on which wind acts in a manner which is compatible with practical use at sea, and to be stowed safely again as well. In particular, one aim in this case is to ensure that the element on which wind acts can be guided from the deck in the deployed state, thus minimizing the listing of the watercraft.

For stowage, the element on which wind acts can be guided to a position in which it can be stowed safely and without problems.

In this case, it is particularly advantageous to provide a holder which can be pivoted in azimuth, by means of which the element on which wind acts can on the one hand be moved for deployment to a position in which it is subject to sufficient wind effect. A docking receptacle apparatus for detachable connection to the docking adapter of the element on which wind acts in this case is in each case directed to the side facing away from the wind, in which case both driven readjustment means and a type of "wind vane" can be provided. The docking receptacle apparatus is in this case designed such that it also allows locking, by holding means which engage automatically, for stowage of the element on which wind acts.

Another particularly advantageous feature is the fact that the element on which wind acts can be launched just by the influence of the wind.

A further advantageous factor is for the launch position to be arranged offset in the horizontal and/or vertical direction with respect to the location of the last hawser guide when the element on which wind acts is in the deployed state. The latter is generally formed by the winch or is located in the vicinity of the winch. This allows the element on which wind acts to be operated independently of the launching apparatus in the operating state.

Another advantageous development is in this case designed in such a manner that in the case of the freely flying kite-like element on which wind acts, a hawser which spreads out into a number of holding cables is connected to the craft, with a connecting cable being provided, which bridges the spreading point and is passed from the docking device on the element on which wind acts to a connecting point, which—seen from the element on which wind acts—is located beyond the spreading point, to the main part of the hawser, and that a lifeline is provided, which originates from the docking receptacle apparatus and whose free end is guided such that it can move with a force fit on the hawser, at least in the area of the connecting cable. This results in the spreading point of the hawser, in whose vicinity the control elements for the aerodynamic adjustment of the element on which wind acts may also be located during operation, being bridged during the stowage process so that it can reliably be pulled onto the docking apparatus. The lifeline can in this case preferably also be formed by a trap or the like, when the element on which wind acts is used on a boat for sporting purposes.

In one advantageous development, an additional lifeline is connected to the hawser via a cable junction which has means in order to move a guide apparatus, which is in the form of a cable slide and is connected to the end of the lifeline, from its position on the hawser onto the lifeline when the element on which wind acts is being stowed, while the element on which wind acts is connected to the cable junction via a further line part. In this case, the cable junction preferably has an essentially T-shaped profile, which is surrounded in an Ω-shape by the guide apparatus. This makes it easier to grip and to stow the element on which wind acts.

If the docking receptacle, which can rotate in azimuth, has an apparatus which in each case automatically places the active direction of the receptacle on the lee side, an automotive stowage process can be implemented such that safe stowage of the element on which wind acts can be initiated automatically even in the event of a possible malfunction of the control part or of a connected appliance which is important for control of the element on which wind acts. When using a lifeline, the receptacle apparatus can also be automatically placed on the lee side by a guide roller for the lifeline being eccentrically connected to the receptacle apparatus so that the element on which wind acts and which is subject to wind pressure automatically draws the receptacle apparatus to the lee side.

In one advantageous development of the invention, the docking receptacle and the element on which wind acts are designed such that a minimal load is exerted on the system by the element on which wind acts in the docked state. This is achieved, for example, by the element on which wind acts being guided at its aerodynamic equilibrium point on the docking receptacle. If this is the case, then the element on which wind acts and onto which the wind is flowing produces precisely the amount of lift which is required to neutralize the force of its weight. The element on which wind acts thus "floats" on the docking receptacle. This docking receptacle need then still absorb only the drag forces which act horizontally on the element on which wind acts, but which are relatively small because the element on which wind acts is docked by its narrow front. As can easily be seen, a system designed in this way results in considerable design advantages.

In another preferred development, the element on which wind acts has a reefing device, in which case the deployment and/or stowage of the element on which wind acts and which to this extent is designed to be flexible take/takes place in a reefed state. In this case, it may be advantageous for stability reasons for the element on which wind acts to have a fixed center part, which cannot be reefed.

The reefing process is carried out advantageously if the reefing mechanism has tension strips which are directed in the direction of the reefing process and can preferably be operated by a winch which is provided within the element on which wind acts, with the reefing process preferably taking place in a side extension of the wing profile. The folds which are created during the reefing process are advantageously wrapped in between areas with a fixed profile cross section, with an identical profile cross section being provided essentially over the entire wing length.

In one advantageous development, the element on which wind acts is designed such that it is slightly curved over its width. This makes it easier to reef the element on which wind acts, since the friction forces of the reefing strips in the element are reduced. This development has the further advantageous feature that the reefed element on which wind acts has less height than a reefed element on which wind acts with a large amount of curvature. However, the flying characteristics are considerably improved when the height is reduced, thus making it easier to control the element.

In order to increase stability, at least one inflatable element is advantageously provided in the area of the wing leading edge and/or between the areas with a fixed wing cross section, and is also used to assist unreefing.

In one preferred development, the raised position forms the upper end of a crane which, in particular, is telescopic and in which hydraulic cylinders are preferably connected to adjacent or successive telescopic segments, for drive purposes.

The mobile crane advantageously has an aerodynamically clad connecting element in the area of the receptacle which can pivot in azimuth, and this connecting element has a supply and a connecting element for compressed air, which can be connected to the inflatable body of the element on which wind acts.

In one advantageous development, a powerful fan, which is also suitable for suction operation, is provided either at the foot of the crane or in the system docking receptacle. In this development, an opening with a relatively large cross section is located in the center of the leading edge of the element on which wind acts and is connected flush to the docking receptacle in the docked state, in such a manner that the element on which wind acts can be quickly inflated or deflated by means of the fan. As can easily be seen, this apparatus allows the deployment and stowage processes to be speeded up.

It is also advantageous to initiate a reefing process for a freely flying element on which wind acts via a remote control or by means of the output signal from at least one sensor element, in which case the deflation process can also be initiated for an element on which wind acts and which has an inflatable element.

An emergency reefing process is in this case preferably initiated by rapid opening of a closure area which closes the inflatable element, in particular together with the hawser of the element on which wind acts being pulled in quickly.

In order to keep the stowage forces small, the element on which wind acts is caught via an attachment which is arranged at a point for which symmetrically acting wind forces compensate in the horizontal and vertical direction.

The described invention is particularly suitable for seagoing vessels or for those which travel in regions in the high-seas area.

Further advantageous exemplary embodiments are described in the dependent claims.

BRIEF DESCRIPTION OF THE DRAWINGS

One advantageous exemplary embodiment is illustrated in the figures, in which.

DETAILED DESCRIPTION OF THE PREFERRED EMBODIMENTS

Figures 1, 1A:
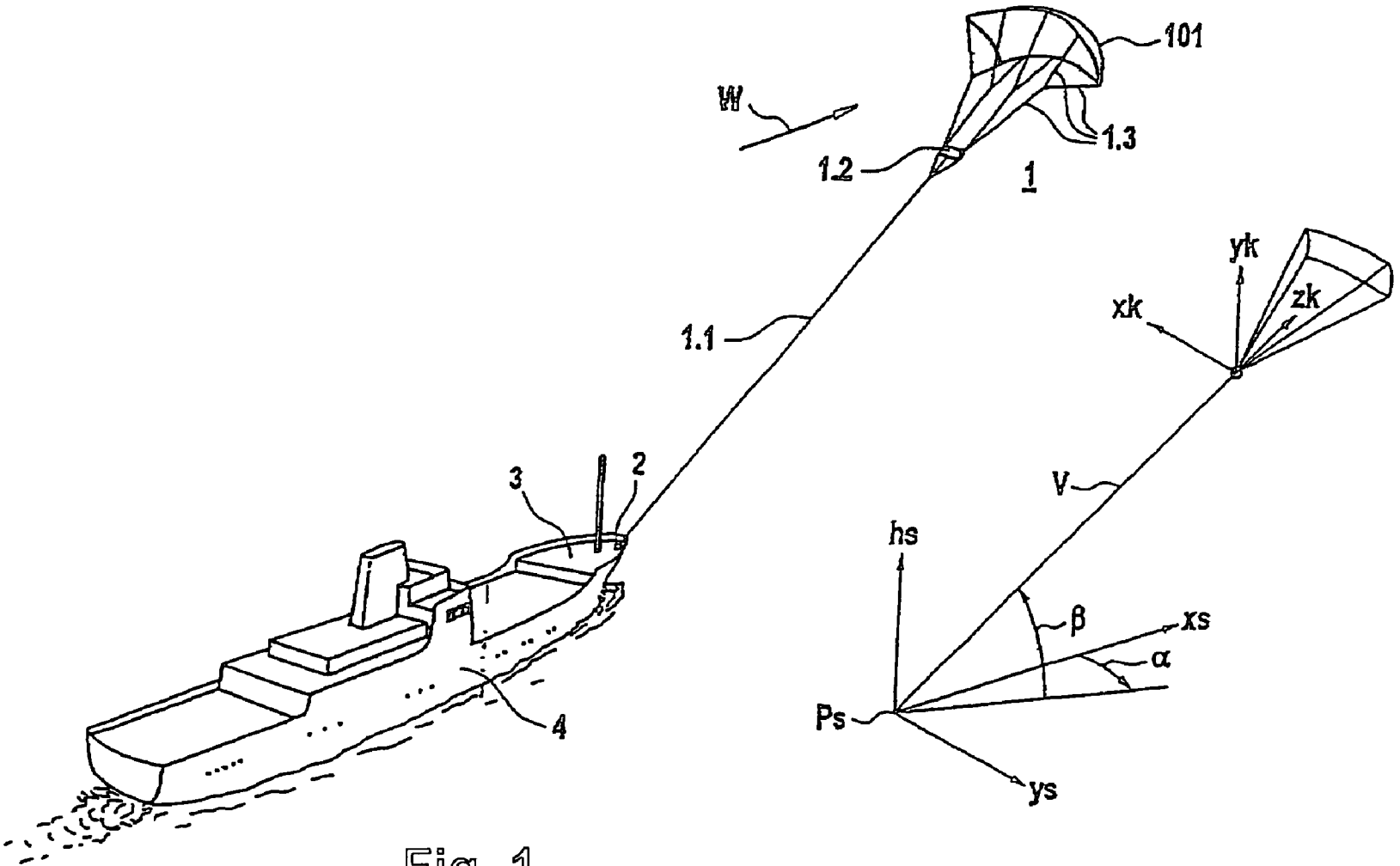
FIG. 1 shows an oblique plan view of a vessel which is being towed by the kite system.
FIG. 1*a* shows a coordinate system which is used as the reference system in the following description.

FIG. 1 shows an oblique plan view of a vessel which is being towed by the kite system. In this case, an element 1 on which wind acts is connected to a vessel 4 via a hawser 1.1 with an apparatus 2 on which force acts and which is provided in the bow area of the vessel 4. The hawser 1.1 is passed to a central gondola 1.2, from which a number of holding lines 1.3 originate, which are passed to the element 1 on which wind acts and is in the form of a paraglider with a kite profile, giving it the necessary shape. The details relating to this will be explained further below in the description. The apparent wind direction in the area of the element 1 on which wind acts is annotated W. The corresponding wind vector is indicated by its magnitude and direction. If required, its rate of change is also indicated by a variable B, which denotes the gusting, forms the mean time discrepancy between the wind speed and its mean value and can be represented as a scalar, which effectively forms the radius of a sphere around the tip of the wind vector W.

FIG. 1*a* shows a coordinate system which is used as the reference system in the following description. In this case, $x_s$ indicates the direction of travel of the vessel, and $y_s$ is the direction at right angles to the direction of travel. In this case, the coordinate system should be regarded as being firmly linked to a point $P_s$ on the vessel. This point is preferably the point 2 at which force acts in the bow area. The height $h_s$ in this case corresponds to the direction of the axis z of the conventional coordinate system, and indicates the height above the reference point $P_s$. This reference point is preferably the location at which the GPS antenna of an on-board GPS appliance is fitted, so that the coordinates of a point away from $P_s$, at which another GPS appliance is located, can be produced by subtraction of the coordinates emitted from the two appliances. (If the GPS antenna of the on-board GPS appliance is located at a distance away from the reference point $P_s$, then this could be taken into account by addition of a fixed coordinate difference.)

For simplicity, the following description is based on the assumption of a polar coordinate system, in which the angle $\alpha$ forms the azimuth angle, and the angle $\beta$ the elevation angle. The direction of the vector V thus in this case points to the gondola 1.2 of the element 1 on which wind acts. This is in fact a "geographical coordinate system", since the gondola 1.2 and the element 1 on which wind acts move essentially on the surface of a sphere. The azimuth angle $\alpha$ and the elevation angle $\beta$ thus indicate approximately the geographical latitude and longitude of the position of the gondola on the "world sphere" covered by the vector V. The length of the vector V roughly indicates the length of the hawser 1.1, in which case, initially, its catenary drop will be ignored.

The gondola 1.2 of the element on which wind acts is aligned on the basis of its own coordinate system with the directions $X_k$, $Y_k$ and $Z_k$, where $Z_k$ points in the direction of the extension of the vector V. The rotation of the gondola 1.2 of the element 1 on which wind acts about the vertical axis $Z_k$ is referred to as the yaw angle. Variation of the yaw angle results in a change in the direction of flight of the element 1 on which wind acts. The yaw angle can be varied, inter alia, by actively driving braking flaps (which are described further below) of the paraglider which forms the element 1 on which wind acts. This results in a direction change, and this process is comparable to the steering of a steerable kite. Rotation about the longitudinal axis $x_k$ represents a rolling movement and is not actively controlled. The catenary drop of the hawser 1.1 resulting from the force of gravity can be determined from the rolling movement and the corresponding discrepancy between the direction from $Z_k$ and V, while the rotation about the lateral axis $y_k$ forms the pitch of the element on which wind acts about the lateral axis, and can be caused by gusts and their influence on the hawser 1.1. This reference system forms the basis for understanding of the description of the vessel/kite system which is described further below.

Figure 1B:
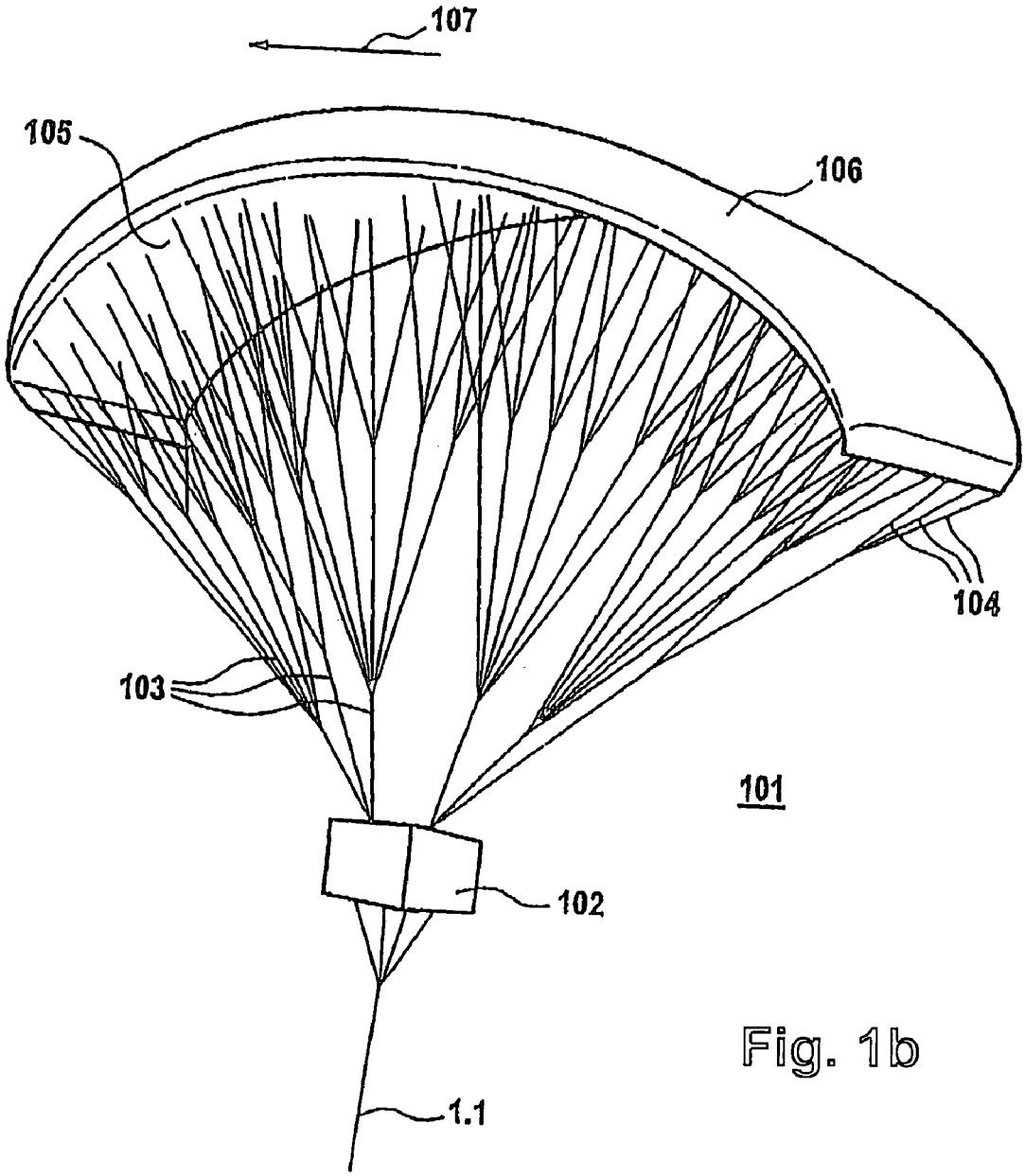
FIG. 1*b* shows one exemplary embodiment of the element on which wind acts according to the invention, in the form of a paraglider.

One exemplary embodiment of an element on which wind acts is illustrated schematically in FIG. 1*b*. The element on which wind acts in the illustrated embodiment forms a paraglider 101 with a container 102 for the controller, as will be described in more detail further below. Holding lines 103 originate from the container 102, which is attached to the hawser 1.1, and merge into branches 104 in the form of a line tree, which are connected to a lower textile covering layer 105. An upper textile covering layer 106 forms the closure at the top. The two covering layers are held together by means of internal connecting lines (which cannot be seen in the figure) or corresponding connecting elements, such as textile ribs, with the wing profile which is formed by the two covering layers being stabilized by an internal increase in the air pressure, which is built up via openings in the leading edge of the kite (on the left in the drawing), which are likewise not shown in the drawing, for clarity reasons. The direction of flight is indicated by the arrow 107.

Figure 2:
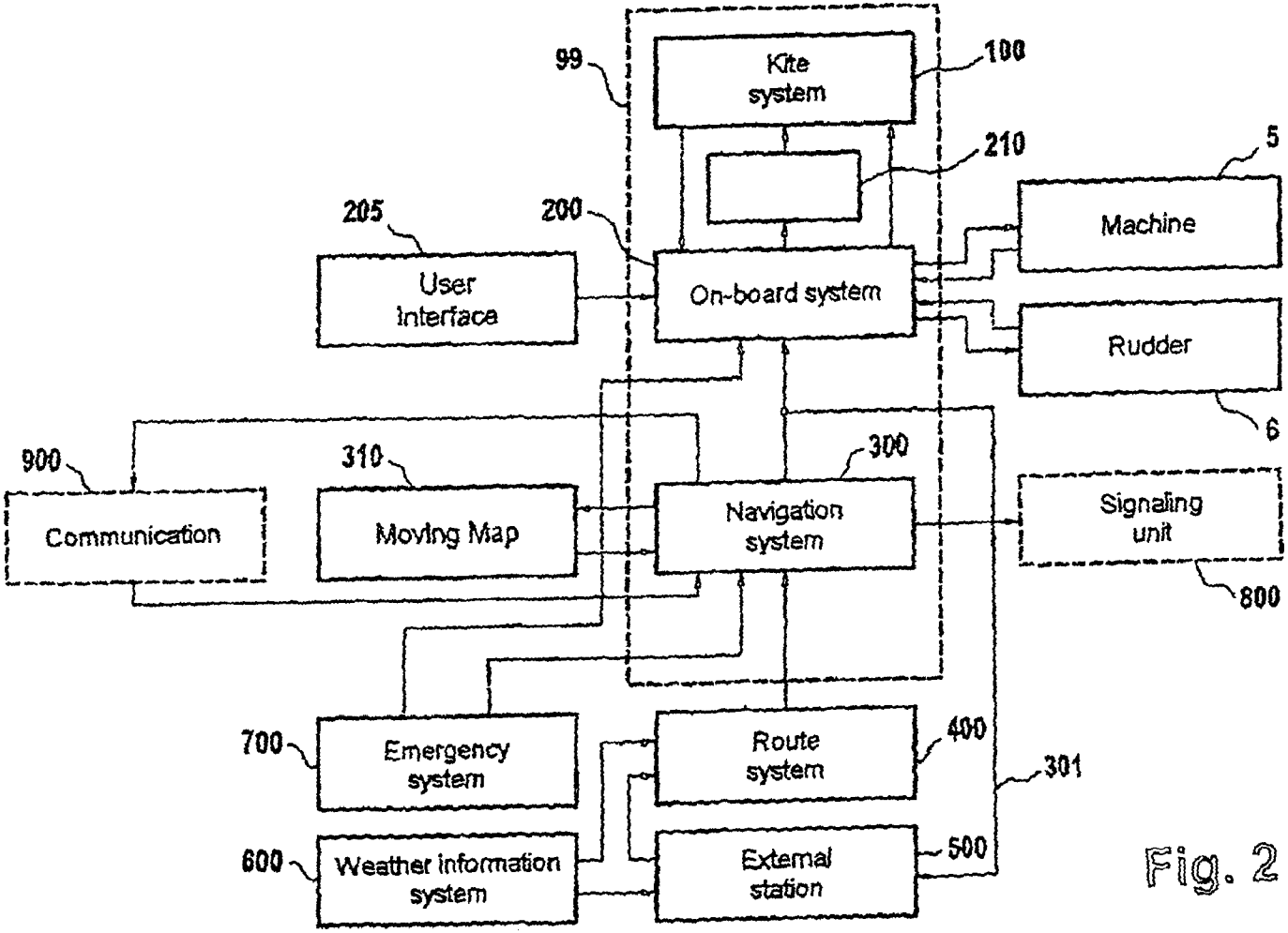
FIG. 2 shows an outline circuit diagram for control of the element on which wind acts, illustrated schematically.

FIG. 2 shows an outline illustration of the wind propulsion system, in the form of a block diagram. The figure also serves for orientation in the following description of the individual system components. Those reference symbols in the 100-series which are used in the overview illustration also form the group designation of the system parts which are each described in more detail further below. (A dashed line 99 in this case surrounds those assemblies which, at the least, must be added to a conventional vessel for it to be additionally equipped with the wind propulsion according to the invention). The system 100 on which wind acts comprises the element on which wind acts as well as the associated control system, if the latter is arranged directly in it. The arrangement may in this case not only be arranged in a gondola which is located at the end of the hawser and from which the holding lines originate, but may also be incorporated directly in the element on which wind acts. The control system essentially comprises an autopilot, which controls the attitude and flight path of the element on which wind acts.

The system 100 on which wind acts is connected via the hawser and a winch 210 (including the hawser) and communication paths, represented by dashed lines, to the on-board system 200 to a user interface 205, which comprises a control system which not only controls the kite position but also emits the necessary control commands to the machine 5 and to the vessel rudder 6. The on-board system is connected to the element on which wind acts via various communication paths which allow not only the kite position to be predetermined in principle by the on-board system but also allow information which is important for the on-board system to be received from the system on which wind acts.

The on-board system 200 is preceded by a navigation system 300, which transmits to the on-board system the route to be maintained by the vessel, taking into account costs, times, speed and wind utilization, possibly as well as the wind direction and wind strength. The wind information may also include a parameter which characterizes how gusty the wind is. Furthermore, this may also include information relating to the sea state and to the vessel movement resulting from it. (The wind and weather data in this case come originally from the weather information system 600, which is described further below). The navigation system is assisted by the navigational information base (moving map) 310.

The course, wind and wave information are used to generate signals which drive the on-board system 200 and results in appropriate adjustment of the kite system 100. The on-board system 200 also produces drive signals for the machine 5 and for the rudder 6.

The navigation system 300 is driven by a route system 400, which determines the course of the vessel by means of the economic basis on which the vessel operation is based. The route system 400 is driven on the basis of data which is predetermined by an external station 500 and is matched to the data from a weather information system 600. The course data currently determined by the navigation system 300 is fed back to the external station 500 via a feedback link 301 (by radio, satellite). The data can also be received by other vessels equipped with the system according to the invention and can be used for local updating of, the weather system. This also makes it possible to take into account current, locally dependent course changes for the rest of the external predefinition of the route.

As can be seen, the kite system 100 is positioned as a function of the course data such that an optimum route is preset both on the basis of the weather conditions (actually occurring winds and sea-state conditions) and taking into account the economic constraints which are intended to ensure that the vessel is operated to save as much cost as possible.

An emergency system 700 provides the required control commands in the event of an unpredicted event which necessitates immediate action in the form of an emergency maneuver.

The signaling system and communication system are respectively combined in further blocks 800 and 900, and match the navigation to further vessels. The signaling system includes navigation safety lighting as well as the transmission of its navigation data by radio, which informs other vessels located in the vicinity about the deployed system on which wind acts and about the intended route and the current course. In contrast, the communication system includes all of the systems which relate to the rest of the information interchange process.

The main dataflow paths are represented by solid lines in FIG. 2, while the other message paths are represented by dashed lines.

Figure 3:
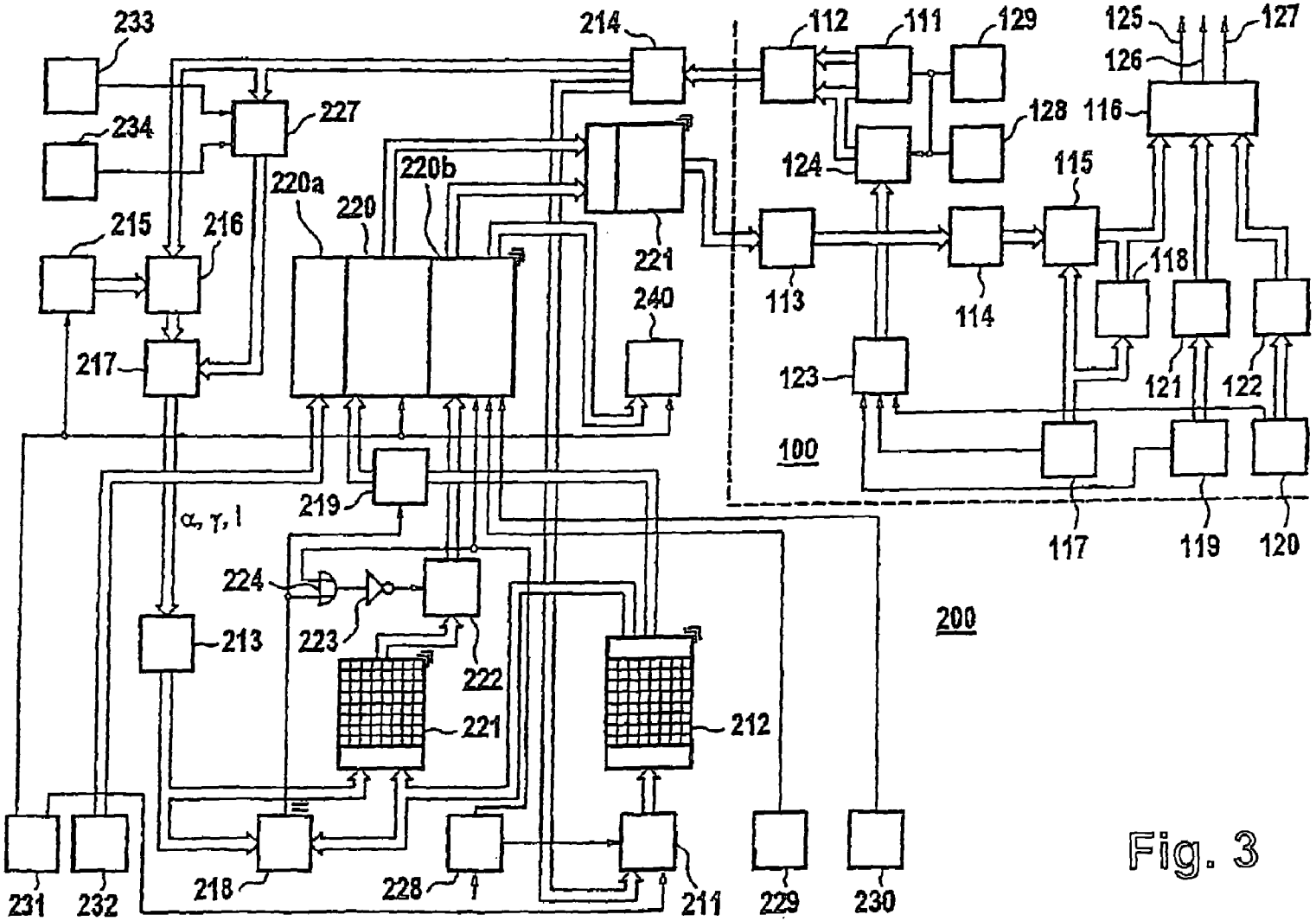
FIG. 3 shows a block diagram of the control of the wind propulsion system, as a block diagram illustrated in detail.

FIG. 3 illustrates in more detail the block 100, which comprises the system on which wind acts, as well as the block 200 with the on-board system from FIG. 2. The positioning and the control of the kite 101 are described here. The wind-direction and wind-speed information, including the gust characteristic as well as the sea-state information, are passed to a buffer store 211 in which this data is stored for buffering. Since the wind direction and all of the kite settings relate to the apparent wind, the course information is irrelevant during the processing. The adjustment and the maneuvering of the element on which wind acts with respect to the vessel does not require any knowledge of the current course, since all of the maneuvers relate to the vessel and to the influence of the apparent wind acting on the kite. During the deployment of the kite 101, the wind information initially comes from the weather information system 600 in FIG. 2, with regard to the positioning of the kite. As soon as its own wind measurement is operational after launching, however, the apparent wind at the location of the element on which wind acts is itself determined, since this is the governing factor for positioning.

The wind data and sea-state data together form a data record which addresses a memory 212, which forms a look-up table, for the required position and the maneuver type of the element on which wind acts. This look-up table is organized in the same way as a normal addressable memory, with the output data from the buffer store 211 addressing, as address signals, the individual memory locations in which the state data associated with the addressed data for the element on which wind acts are stored. A "look-up table" such as this links the input data and output data with one another in the form of a "read only memory" (ROM) in accordance with a predetermined functional relationship, and can thus be understood as a mathematical association (function). However, the corresponding blocks form only one example of an implementation and can also be replaced by any other desired functional elements or assemblies. By way of example, this may comprise a microprocessor in which the control software is stored in an appropriate memory, or else it may be an electrical circuit in which the functional relationship is defined in the form of an analog computer by the electrical components involved. The representation in the form of a look-up table has been chosen here for the sake of clarity, because a solution with a microprocessor, for example, can be represented less clearly only because the various program steps, which have to be carried out successively, require complex considerations relating to which program parts must be supplied successively to the microprocessor.

In the chosen embodiment, the control signals can be processed in parallel, although those switching elements which result in activation of the illustrated blocks at specific times and the corresponding control processes, are not illustrated. For the sake of simplicity, it is assumed that an incoming control signal which differs from the previous signal state which initiates the processing in the downstream blocks, which retain the relevant state that has been reached, forces new processing to be carried out until a signal change occurs.

The state data thus includes on the one hand the required position of the element on which wind acts, that is to say its direction with respect to the vessel and the length of the hawser to be deployed. Furthermore, if required, it also contains information about whether and when the kite 101 should in fact be maneuvered on the basis of which stored program. While the kite is guided in the steady state, that is to say in a fixed manner, in a number of positions, it is better for vessel operation in some circumstances for the kite to be controlled dynamically, that is to say for predetermined flight figures to be carried out, since this increases its relative speed with respect to the wind and, as a consequence, its towing power as well. The current position of the kite is stored in a further memory 213, as determined by the navigation system of the kite 101.

The actual position of the kite, which is stored in the memory 213, relates to the vessel and is preferably determined by subtraction of two GPS signals. This relates on the one hand to the GPS receiver 124 for the kite 101 within the kite system 100, which is connected to the flying kite 101. The position data determined in the flight position of the kite 101 is transmitted by means of a transmitter 112 to a receiver 214 which is located on board the vessel. A further GPS receiver 215 is likewise provided on board the vessel. Its output signal together with the output signal from the receiver 214 are supplied to a subtraction unit 216, by means of which the differential GPS signal is produced. The difference position data is converted in a block 217, which is connected downstream from the subtraction unit 216, to polar coordinates, which relate to the distance between the winch 2 and the position of the element on which wind acts. These are the angles $\alpha$ and $\beta$ as shown in FIG. 1*a* as well as the cable length "L". The differential GPS position data obtained in this way is highly accurate if determined at the same time and if the vessel GPS receiver is installed at a location which is affected as little as possible by vessel movements, or if the movements are compensated for.

Furthermore, in this case, it is necessary to take account of the coordinate difference between the positions of the winch and of the GPS receiver in the vessel by subtraction of a fixed value. The position determined by the differential GPS receiver formed in this way is determined at time intervals. If its precision is not adequate, it can be assisted by values which are determined by means of acceleration sensors 117, 119 and 120. The corresponding calculations, which include an integration process, are carried out in the assembly 123. Since only the times which pass before the next GPS position signal are of relevance for the time intervals within which the integration process must be carried out, the integrators do not need to comply with any quality requirements which would guarantee stability over long time periods. (The acceleration sensors are intrinsically used for stabilization of the flight maneuvers, as will be described further below—that is to say they have a dual function). Furthermore, an altimeter 129 (preferably in the form of an air pressure meter) and an earth's magnetic field sensor 128 are provided, with the data items from both of these likewise being supplied to the memory for the navigation signal 124.

A further possible way to determine the actual position of the element on which wind acts with respect to the vessel is to use the data transmitted to the vessel from the altimeter 129 and from the earth's magnetic field sensor 128. This data is transmitted to the vessel in block 227, and is stored. A subtraction process is then carried out in block 227 with the data from the altimeter 233 on the vessel and from the earth's magnetic field sensor 234 on the vessel. If the altimeter 129 is an air pressure meter, weather data from block 600 (isobars) may, however, also be used for determination of the air pressure at the vessel. The position information determined in this way is supplied to the block 217, and if required is matched to the GPS data. This results in the position information from two independent systems being used for mutual support and, if one system fails, the required data is still available.

The required kite position read from the memory 212 is now supplied on the one hand to a comparator 218, which outputs a signal when the actual position of the system 100 on which wind acts, and which position is stored in the memory 213, matches the required position read from the memory 212. In this case, a data record which characterizes the selected maneuver type is read from the maneuver type memory 220 via an enable circuit 219. (In this case, a steady-state flight state may also however be distinguished by the kite not carrying out any maneuvers but remaining in the same flight position. This is the "zero" maneuver type.)

Thus, when this maneuver type memory 220 is activated, a flight program of the sequential type is read, and is transmitted to the autopilot for the system 100 on which wind acts. The output signal from the memory 220 is in this case passed to a transmitter 221, which emits the data and supplies it to a receiver 113 for the system 100 on which wind acts. The signal is passed from the output of the receiver 113 to an autopilot assembly, and from there to a maneuvering control unit 114, which receives signals which identify specific sequential flight maneuvers and converts them to turn values which are supplied to the flight processor 116, which carries out the relevant flight maneuver. In this case, the value to be set is transferred to a turn value comparator 115 to which, on the other hand, the input signal of the yaw value meter 117 is supplied. The flight processor 116 now produces turning flight in the predetermined sequence and for the predetermined duration at its relevant output 125 via an appropriate drive element on the kite 101 by asymmetric braking of the kite 101 or appropriate aerodynamic deformation. The other aerodynamic effects, which are driven by the two other outputs of the flight processor 116, are adjustment of the wing incidence angle and the reefing process, as will be described further below.

The winch 240 is also driven from the positioning memory 220*b* in order to feed out to a specific required cable length.

In order to prevent oscillation about the vertical axis, a signal which has been filtered by means of a high-pass filter is additionally supplied to the flight processor 116, superimposed on the control signal but with an offset phase angle, thus preventing the start of oscillations. While yaw movements can be controlled via the output 125, the incidence angle of the wing is set via the output 126. As is known, the lift/drag ratio can be optimized by the magnitude of the incidence angle of a wing. The reefing of the kite 101 can be initiated via a further output 127. Reefing changes the lift and drag, and may be necessary for individual flight maneuvers.

Since the kite is guided firmly on the hawser, it is automatically stabilized by the tension effect of the cable at its center of lift, with regard to its rolling and pitching movements. However, in order also to preclude oscillations in this case, an attitude signal is in each case transmitted in a corresponding manner from a roll sensor 119 and a pitch sensor 120 via corresponding inverting high-pass filters 121 and 122 to the flight processor, thus avoiding and compensating for sudden attitude changes of the element 101 on which wind acts.

Thus, when the kite is in its predetermined position (an output signal which identifies this state appears at the output of the comparator 218), then the selected maneuver type is read, which causes the kite to carry out a predetermined cyclic flight program. If this maneuver type is transmitted, the control is carried out automatically by the autopilot for the element on which wind acts, and the unit 200 no longer need react provided that the kite does not leave its required position as a result of unpredicted events.

If the required position of the element 101 on which wind acts does not match its predetermined position, possibly because the preset position which has been read from the memory 212 has changed—as is also the case when the kite is deployed—or possibly because the kite has left its position during the course of the maneuvering, then the output signal at the output of the comparator 218 disappears, and the maneuver type, activated via the switching element 219, of the memory 220 ends. The signal "zero" appears at the output of the memory for the maneuver type 220 (left-hand part), and this is interpreted by the autopilot of the system 100 on which wind acts as meaning that the most recently stored maneuver is no longer being carried out. Instead of this, the actual position of the kite, which has been read from the memory 213 and has been determined by GPS, is compared with the required position from the memory 212 by means of a position correction unit 221, and a maneuver is determined which guides the kite to the required position. The correction unit 221 is once again in the form of a look-up table, with the required position and the actual position (once again related to the vessel) being combined to form a common addressing signal, and the identity of a corresponding correction maneuver for the element on which wind acts being read from the actual position A to the required position B. Specifically, care must be taken to ensure that different maneuvers must be chosen depending on the launch and destination point (and possibly also as a function of the wind and wave conditions), in order to maneuver the kite. However, any desired kite maneuvers can be chosen and carried out by means of the stated measures.

If the wind level and sea state play a role in the maneuvers to be carried out, then this data can be "looped-through" from the memory 211 through the look-up table memories 212 and 221, so that this data is still available in the data record for selection of a specific maneuver, and a suitable maneuver can be chosen. However, this does not relate to compensation for individual events, but to general setting guidelines which, for example, may include the kite being flown relatively in a high sea state such that it is possible to compensate as far as possible for the forces acting on the watercraft as a result of the direction of the waves. Thus, for example, if the vessel were to be heeling severely, it would be preferable to use a kite position with a lateral component, while a straight-ahead component would be preferable for a vessel which is pitching severely. For this reason, an output signal from the block 231 for detection of the sea state is passed directly to the block 211, in order to supply information which also affects the choice of the appropriate kite position and maneuvering in the sense described above. A further function of this link is to choose parts of flight maneuvers such that they counteract the accelerations resulting from the sea state. This includes the flying of maneuvers with cyclic flight paths, in which different tension forces act on the hawser at different times, in such a way that these forces occur with a phase shift with respect to the accelerations which are caused by the sea state. This reduces the overall movements of the vessel. This compensation for or reduction in vessel movements by different tension forces, which are caused by the maneuvering, do not interfere with the other methods that are used for sea-state compensation. This is because vessel movements which have been reduced from the start require less effort in order to reduce their effects on the kite flight path. Because of the compensation for the individual vessel movements, reference is made to the description of the block 231 further below.

For position changing, the right-hand part of the memory 220 is addressed via a switching element 222 with the data record that has been read from the correction unit 221, with the switching element 222 being activated by the output signal from the comparator by means of an inverter 223 when the switching element 219 is not activated, that is to say when the required position and actual position are not the same.

Furthermore, the flight stability of the element on which wind acts may also play a role for its position. A multiple-direction ram-air pressure meter 111 provided on the kite on the one hand acts as an anemometer while on the other hand, for that component which is measured in the direction of flight, transmits the state of an incident flow on the kite being excessively low by means of an appropriate signal which, together with the production of a position changing maneuver, also drives the winch controller 240, thus speeding up the change in position of the kite so that the incident flow speed is increased again. (It is evident that the winch can also be driven in the case of "deliberate" position changes resulting from wind data and wave data via the right-hand part of the memory 220*b* in order, for example, to allow the height of the element on which wind acts to be changed).

For determination of the true wind direction and wind speed, the anemometer has pitot tubes pointing in different directions and having pressure capsules which are evaluated separately. The direction and speed of the wind can be determined with respect to the alignment of the anemometer 111 from the pressure values from the three pressure capsules which are directed at right angles to one another and have the highest pressure values. If the output signal from the magnetic-field sensor 128, which contains a bridge circuit composed of magnetically sensitive resistances and thus makes it possible to determine the direction of the lines of force of the earth's magnetic field, is also taken into account, then the direction of the wind can be related to the northerly direction and can thus be transmitted to the watercraft as the direction of the apparent wind on the element on which wind acts. If required, the correction from magnetic north to geographic north is then also carried out in the watercraft.

An arrow pointing to the block 211 indicates that normal navigation of the kite is rendered inoperative in this case. The rest of the normal maneuver control is also suppressed via an OR gate 224 connected upstream of the inverter 223. (This also applies in a corresponding manner to the blocks 228, 229, 230 and 232, which will be described in the following text and initiate further special functions. However, the associated signal links have been omitted there for reasons of clarity).

The block 228 initiates the "emergency jettison" emergency maneuver by selection and starting of the associated maneuver type via the right-hand part of the maneuver type memory 220*b*, which contains the respective programs. This maneuver is necessary when the element on which wind acts results in a major risk to the vessel, as a result of unfavorable circumstances or an accident (for example by collision with an obstruction). In this maneuver, the element on which wind acts is completely disconnected from the vessel.

The blocks "deploy" 229 and "stow" 230 initiate the appropriate maneuvers by selection and starting of the relevant maneuver type via the right-hand part of the maneuver type memory 220*b*, which contains the respective programs.

A block 231 "vessel movements" determines the acceleration component in the direction of the hawser by means of an appropriately aligned accelerometer and, after integration, generates a signal which describes the vessel movements in the direction of the hawser. This signal is supplied to the on-board GPS receiver which produces a position signal (in order to correct the position of the winch controller 240) if the receiver and/or the antenna are/is not themselves/itself mounted in this position. If this GPS position signal were to be evaluated directly together with the GPS position signal received via the receiver 214 from the kite system 100 and were to be used to control the kite 101, then the kite 101 would follow the sea-state movements of the winch in its control process. However, since the kite 101 is intended to fly its maneuver with respect to an imaginary stabilized vessel position, the integrated signal from the accelerometer is additionally supplied, in block 231, to the GPS receiver 215 in order to be subtracted (as a disturbance) from the signal which is supplied to the block 216 for processing, so that the position signal of a "stabilized platform" is processed there. This results in the kite 101 flying maneuvers which are free of sea-state disturbances. Specifically, it can be seen that the sea-state components acting in the hawser direction have the main effect on the flying object while in contrast components in the lateral direction with respect to this contribute only to a change in the angles $\alpha$ and $\beta$, of the flight vector which tends to zero when the hawser is long, and can thus be ignored.

In order to avoid the occurrence of a situation all the time in the described exemplary embodiment in which a flight maneuver that is being carried out is interrupted, when the sea state is high, by the detection of a discrepancy in the difference block 218, with the need to carry out a controlled "flight" to the correct position (in this case by activation of the winch 240 via the right-hand maneuver block 220*b*), there is a direct link from the block 231 to the winch controller 240. The winch controller 240 directly receives the command to pay out and to wind in, in response to the sea-state movement in the hawser direction being found by the block 231, so that the vessel movements are compensated for directly for the kite. A position correction by means of an appropriate maneuver is initiated only when this compensation is no longer sufficient, for whatever reason.

In order to allow maneuvers to be initiated manually as well, the appropriate input commands can be made by means of a user input 232, which is part of the user interface 205 in FIG. 2. Appropriate commands can be used to directly transmit control commands to the autopilot unit and to the winch controller 240 in the left-hand part 220*a* of the maneuver memory for manual commands, with the rest of the signal output from this memory being suppressed. These comprise the functions "left", "right", "straight", "reef", "unreef", "incidence (+)", "incidence (−)", "winch (+)" and "winch (−)". The intensities of all of the commands can be modulated.

In the case of one variant which is included in the described embodiment, "predictive maneuvering" is carried out by inputting fictional wind and course data into the system in order to calculate the current position of the element on which wind acts, with the configuration that is then selected being displayed for information. The vessel control system can then estimate the predictable behavior of the system from this, and can appropriately adjust the navigation. This multiple processing of the data in the form of possible prediction is represented in FIG. 3 by multiple angles at the corners of various memory elements, with the aim of indicating that the contents of these memories are evaluated more than once, independently of the current process control. Thus, in this case, additional memory means and comparative means are provided, which allow storage of signals associated with previous times with signals which occur at later times in such a manner that successive maneuver states can be compared on the basis of different—including fictional—input data.

Figure 4:
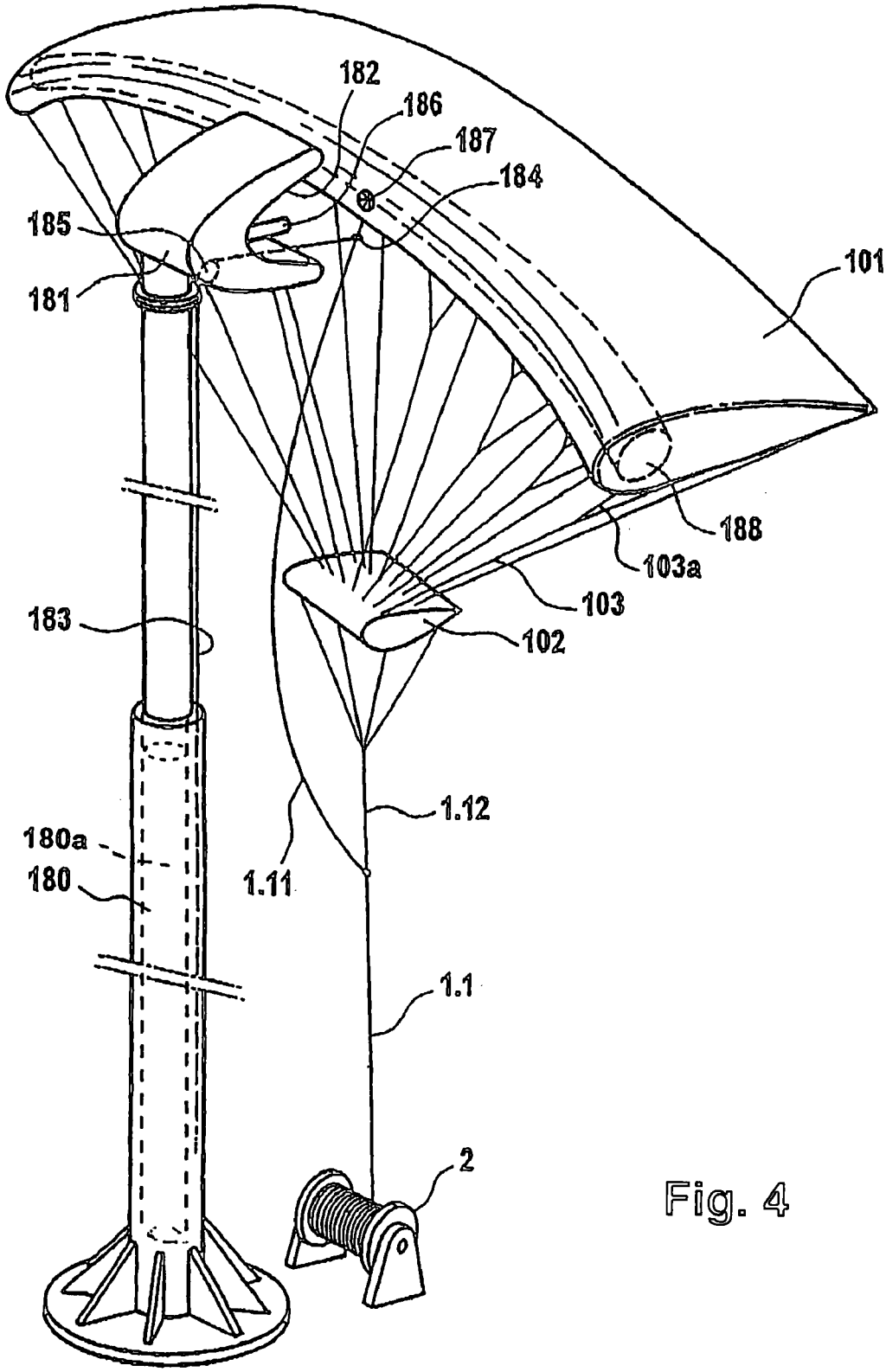
FIG. 4 shows a docking apparatus for the element on which wind acts, illustrated in perspective form.

FIG. 4 shows a docking apparatus of the element 101 on which wind acts, in the form of a perspective illustration. A crane 180 which can be extended telescopically and, for example, can be extended by means of a hydraulic cylinder 180*a*, has a receptacle apparatus 181 at its end for docking, which receptacle apparatus 181 has on its inside 182 a recess profile which is matched to the external profile of the element 101 on which wind acts in the area of its leading edge. That side of the receptacle apparatus 181 which faces away from the element on which wind acts is designed to be streamlined, since it points in the windward direction during docking. In addition, it should not interfere with the incident flow onto the element 101 on which wind acts.

Figure 4A:
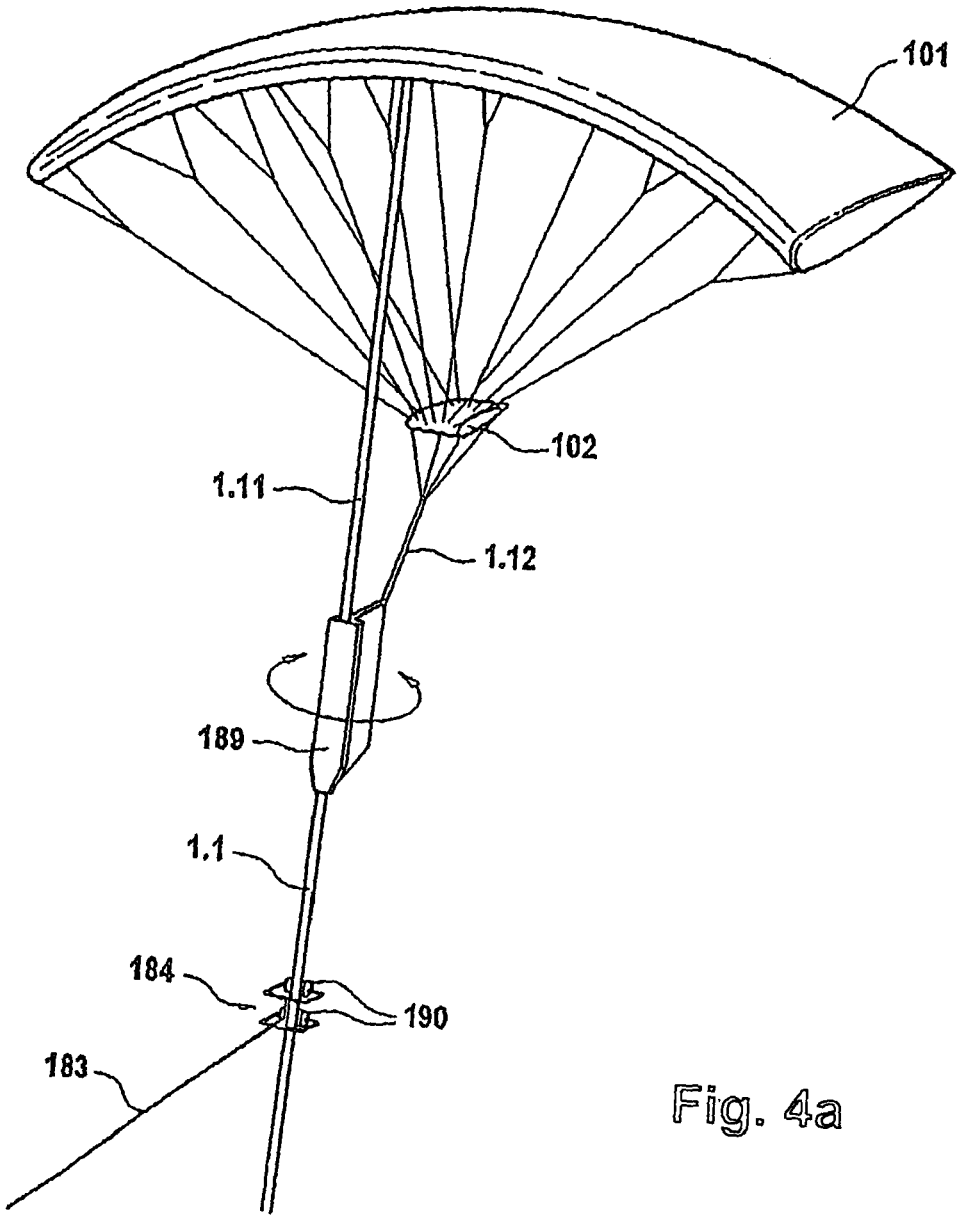
FIG. 4*a* shows a detail of the docking apparatus as shown in FIG. 4, illustrated in perspective form.
Figure 4B:
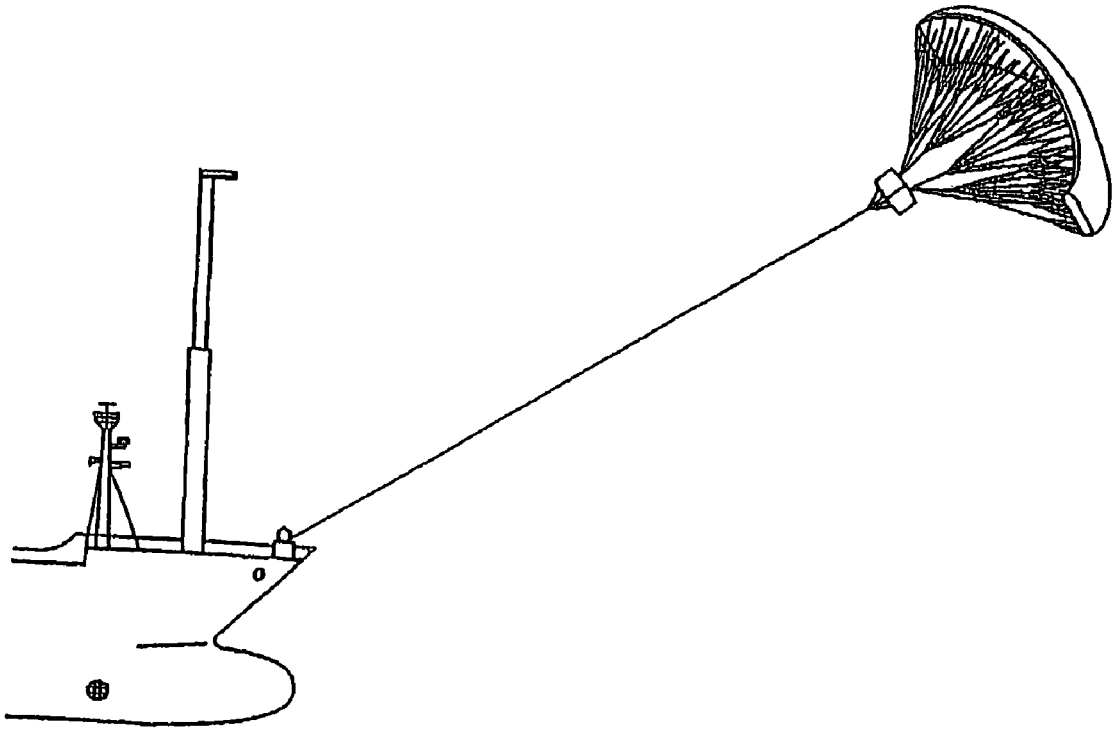
FIG. 4*b* shows a further detail of the docking apparatus as shown in FIG. 4, illustrated in perspective form.
Figure 4C:
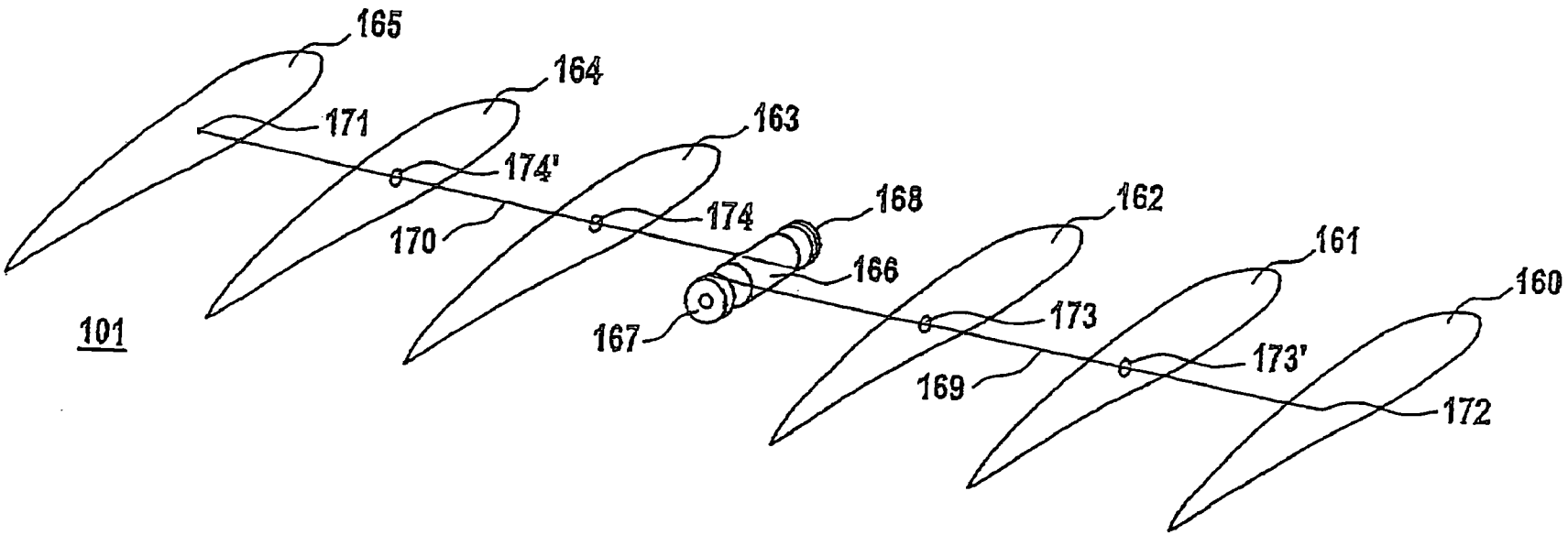
FIG. 4*c* shows a reefing device for the element on which wind acts, illustrated schematically.
Figure 4D:
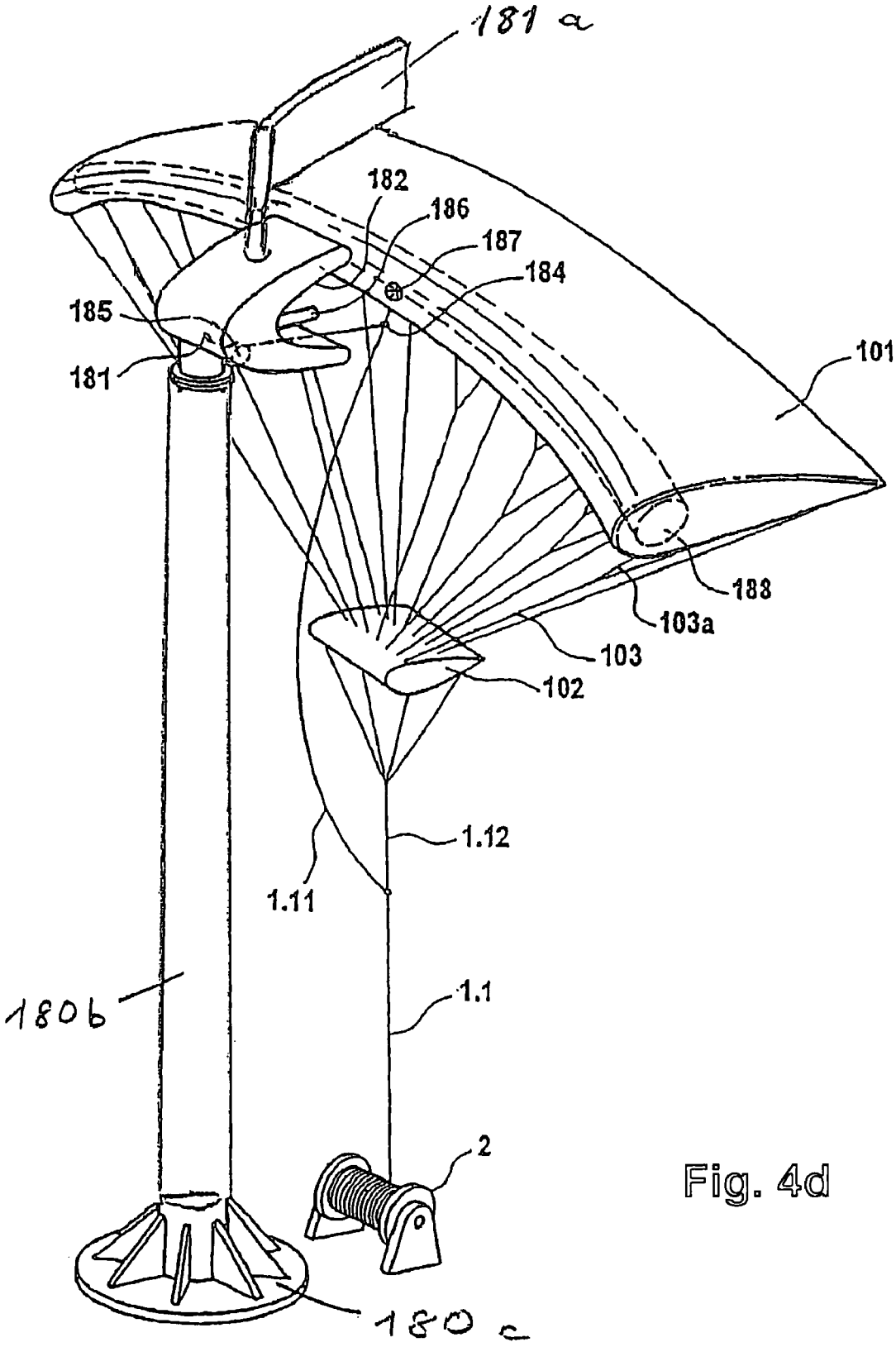
FIG. 4*d* is view similar to FIG. 4, but showing a modification of the docking apparatus.

In place of the hydraulic cylinder 180*a* for the crane 180 as shown in FIG. 4, this part of the crane 180 can be an inflatable element 180*b* as shown in FIG. 4*d*. After the element 180*b* has been deflated it can be pulled through the part 180*c* into a compartment below the deck.

A lifeline 183 is guided within the crane 180 and is used to pull the element on which wind acts onto the mast once this has been pulled in, during stowage, by means of the winch to the same height as the extended crane 180. The free end of this lifeline 183 is fitted to the hawser close to the winch 2 by means of a guide apparatus 184 which will be described in detail further below and by means of which it "rides" on the hawser 1.1 and then on the stowage line 1.11 which branches off before the gondola 102, and is then pulled until it assumes the position illustrated in FIG. 4. The receptacle apparatus 181 is mounted on the upper end of the crane 180 such that it can rotate. In the area of the inside 182, the receptacle apparatus has a guide or guide roller 185 for the lifeline 183, which is located eccentrically in the direction of the lee away from the azimuth rotation axis of the receptacle apparatus. The receptacle apparatus 181 is thus automatically rotated by the tension on the lifeline 183 in the leeward direction in order to hold the element 101 on which wind acts.

In one advantageous development of the invention, as shown in FIG. 4*d*, the receptacle apparatus 181 is provided on the outside with a wind vane 181*a*, so that the wind pressure automatically results in it pointing in the direction of the element on which wind acts. This is particularly advantageous during stowage.

As the stowage line 1.11 is pulled further, the front profile nose of the element 101 on which wind acts moves closer to the receptacle apparatus 181. A filling tube 186, which is provided on the receptacle side of the receptacle apparatus 181, enters a valve opening 187 which is connected to an inflatable bead 188 (illustrated by dashed lines) in the area of the leading edge of the wing.

The bead 188 is used to unreef and to stiffen the element on which wind acts during deployment while the air enters it during deployment, before the element on which wind acts leaves the launch crane. During stowage, the filling tube just has to open a valve in order to release the stiffening medium (preferably compressed air). In this case, the mechanism is preferably modeled on the float body of a conventional inflatable boat.

Figure 4E:
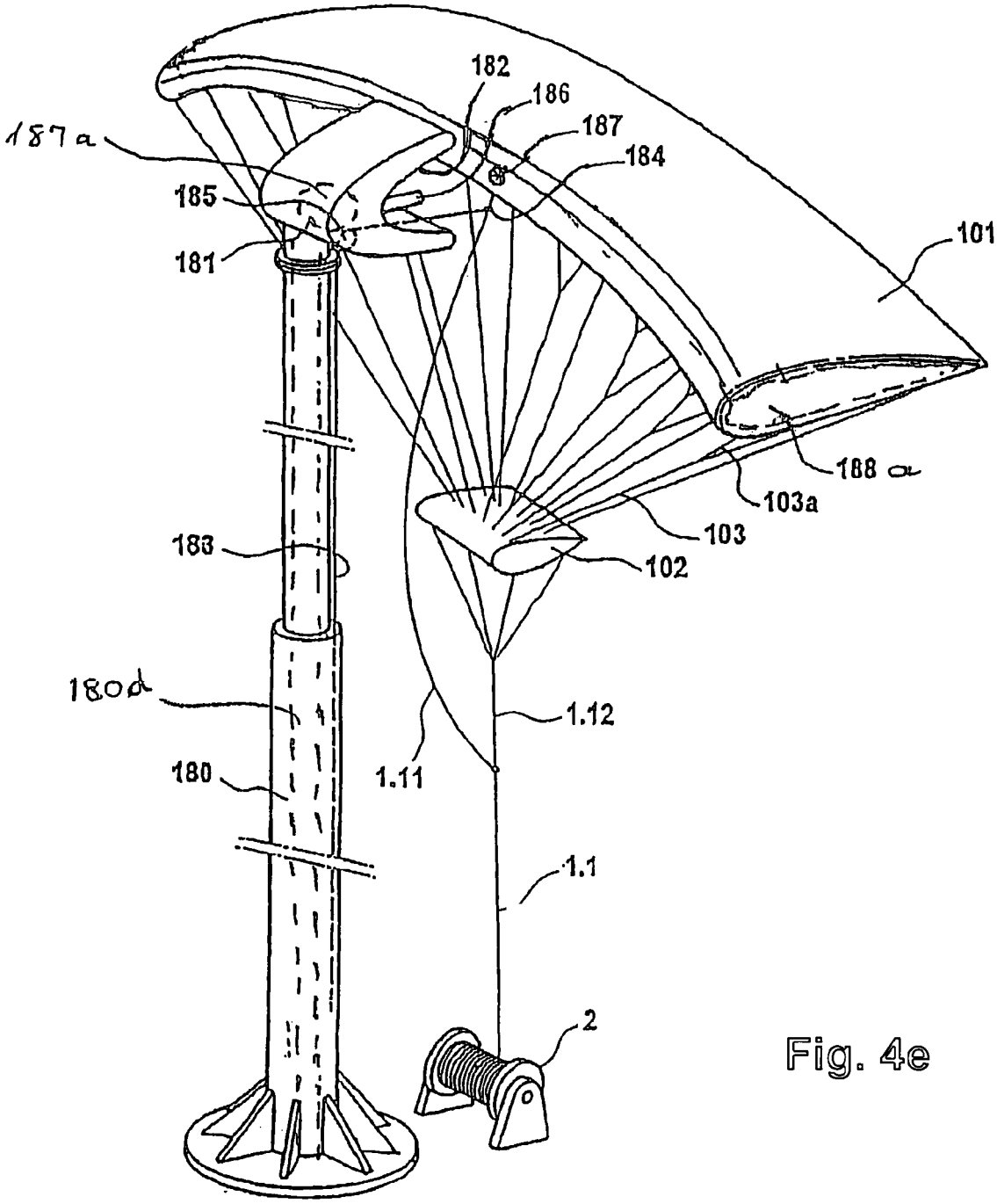
FIG. 4*e* is a view similar to FIG. 4 but showing a modification of the inflatable element.

According to the modification shown in FIG. 4*e*, the inflatable element 188*a* occupies the entire hollow area of the element 101 on which the wind acts.

In one development the crane 180 as shown in FIG. 4*e* the crane 180 is designed to be essentially hollow as shown at 180*d*. A fan 187*a* is provided in the receptacle apparatus 181 or at the foot of the crane 180 and can also be operated in a suction mode. A large cross-section air channel is incorporated in the receptacle apparatus 181 and emerges on the inside 182. The element 101 on which wind acts has an opening which is formed in a corresponding manner to the outlet opening of the air channel, so that the docked element 101 on which wind acts can be inflated or deflated (in the suction mode) by starting up the fan. This allows faster deployment and stowage.

In order to prevent hazardous situations during deployment and stowage, the crane and the claddings are rounded on the outside, and are designed such that they do not have any projecting edges, corners or other projecting parts.

The perspective illustration of the detail (illustrated in FIG. 4*a*) of the docking apparatus as illustrated in FIG. 4 shows a cable junction 189 which ensures that the guide apparatus 184 which is connected to the end of the lifeline 183 moves from its position on the hawser 1.1 during stowage of the element 101 on which wind acts onto the stowage line 1.11 while the lifeline is being pulled in. The junction 189 preferably has a T-shaped profile, which is mounted adjacent to the hawser 1.1 and has a lateral-limb width which continues in a corresponding manner to the thickness of the hawser, or even has a width greater than this. The vertical limb of the T-shaped profile is kept narrower and merges into the continuation of the hawser 1.12, which leads to the container 102 of the gondola, to which the holding lines 103 of the element 101 on which wind acts are attached. Since the guide apparatus 184 surrounds the hawser 1.1 in an Ω shape, and guide elements 190 thus grip behind the hawser (comparable to a guide for wardrobes on a T-rail), the guide apparatus 184 moves reliably from the hawser 1.1 to the stowage line 1.11, although the path of the main tension force is passed into the hawser continuation 1.12.

In one alternative embodiment, which is not illustrated, the stowage line 1.11 ends in an apparatus which at least partially surrounds the hawser 1.1. The apparatus is designed in such a manner that it fixes the end of the stowage line 1.11 at a defined position of the hawser 1.1. When the element 101 on which wind acts is being stowed, the guide apparatus 184 of the lifeline 183 thus rides upwards on the hawser 1.1, and abuts against the apparatus, which fixes the stowage line 1.11 on the hawser 1.1. This initiates a coupling process so that the guide apparatus 184 and the apparatus for fixing the stowage line 1.11 are connected to one another with a force fit or in an interlocking manner. At the same time, the fixing of the stowage line 1.11 to the hawser 1.1 is released by the coupling process, so that the stowage line 1.11 is now connected to the lifeline 183, but is no longer connected to the hawser 1.1.

FIG. 4*b* shows an overall view of the invention.

The detail (illustrated in FIG. 4*c*) of the element 101 on which wind acts shows a perspective illustration of a reefing device, for interaction with the docking apparatus as shown in FIG. 4. The illustration shows, schematically, the mechanical principle of one exemplary embodiment of a reefing device with an electrical winch and one exemplary embodiment of textile webs 160 to 165 which form the structure (which forms the profile) for the element 101 on which wind acts. The schematic illustration does not show the covering surfaces. An electric servo motor 166 is in the form of a stepping motor and is fitted with two winding disks 167 and 168 at the ends of its driveshaft. These wind up two pulling lines 169 and 170 in opposite senses, with these lines being connected to the respective webs 160 and 165 at respective attachment points 171 and 172. When the motor 166 is activated, then it shortens the pulling lines and pulls on the webs 160 and 165. For the other webs 161 to 164, the pulling lines 169 and 170 are passed through cutouts 173, 173' and 174, 174', so that these are passed only over the folding covering layers of the wing when it is being reefed. Partial reefing is possible by partially pulling on the lines 169 and 170. Unreefing is carried out by activation of the servo motor 166 in the opposite direction, in which case the element 101 on which wind acts and which is in the form of a paraglider resumes the unreefed state by virtue of its curved shape and the tension force on the lines, without any additional operating force.

Figure 5A:
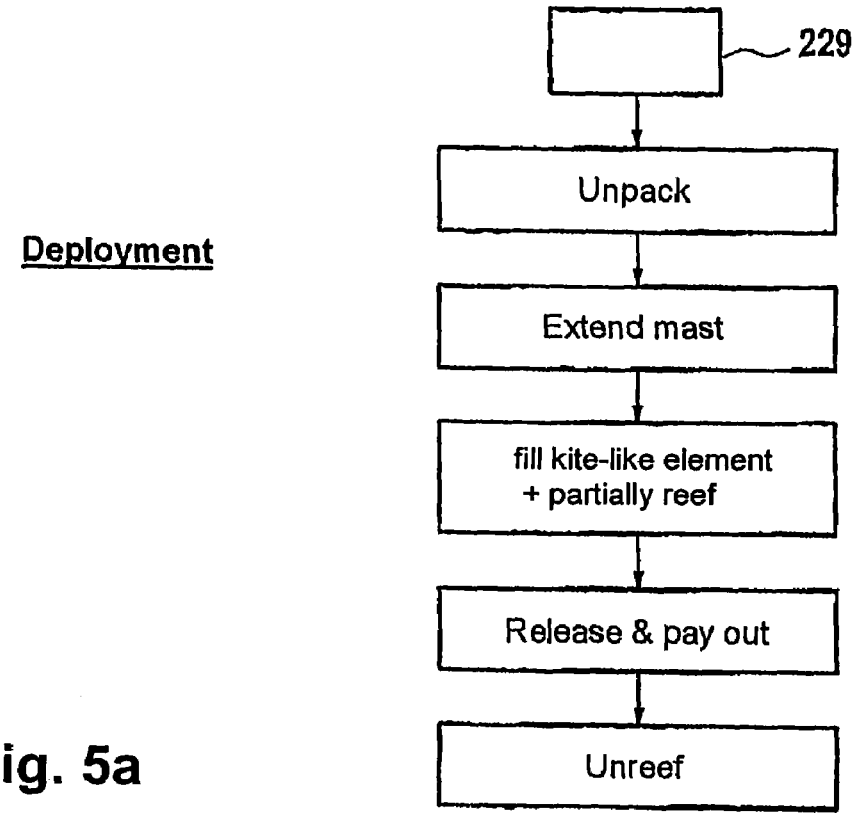
FIG. 5*a* shows a block diagram of a deployment process.
Figure 6A:
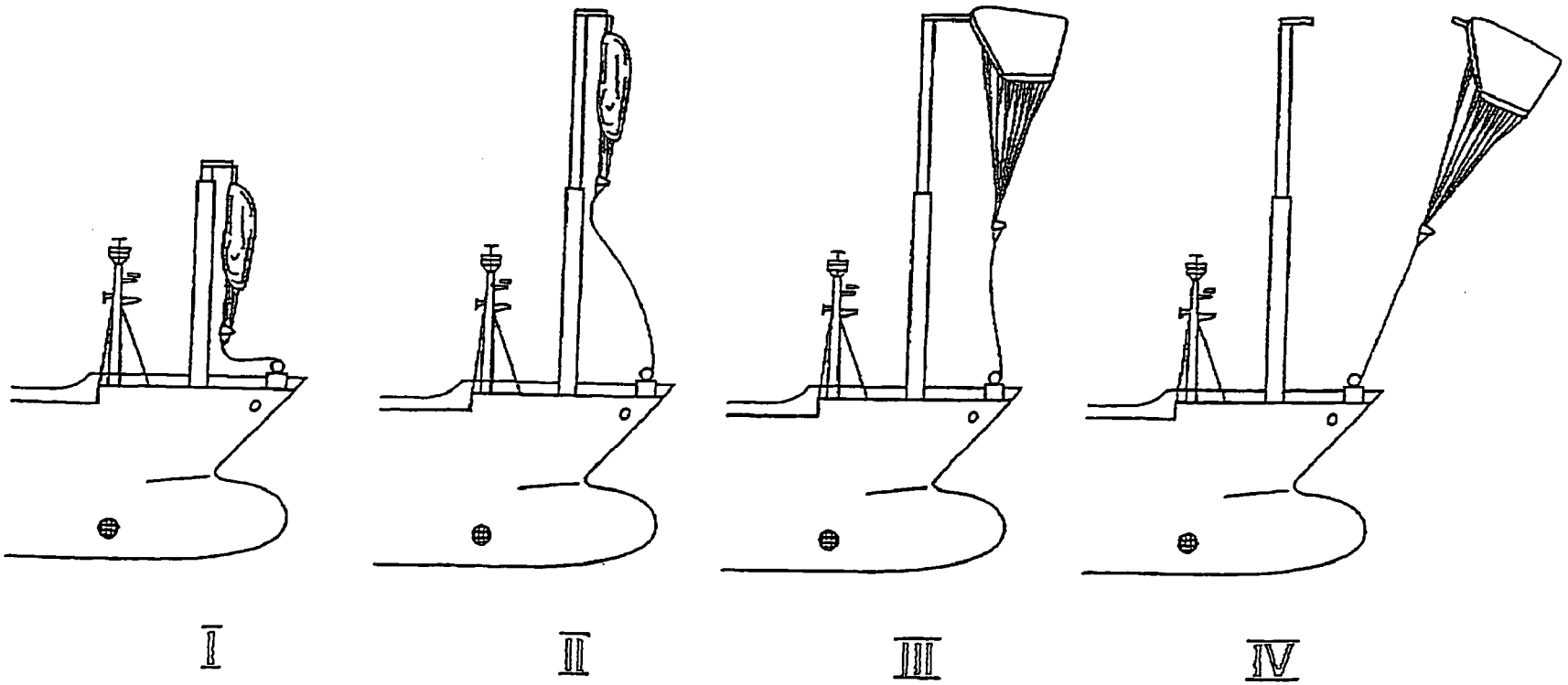
FIG. 6*a* shows a schematic illustration of the procedure for a deployment process.

In the block diagram of a deployment process, as is illustrated in FIG. 5*a*, the following functions are carried out successively after appropriate initiation via the block 229 (FIG. 3) I.: unpacking, II.: extension of the crane, Ill.: filling of the kite-like element including partial unreefing, IV.: decoupling of the kite-like element, release of the control gondola and paying out the hawser as well as V.: complete unreefing initiation, as is illustrated by the corresponding sequence of illustrations in FIG. 6*a* (the unreefing process has not been illustrated, for simplicity reasons). Once the appropriate command has been issued by means of an input via the block 229, the corresponding sequence of control commands is initiated sequentially, fully-automatically or semi-automatically, by means of an appropriate control circuit, initiating the described function via the respective mechanism.

Figure 5B:
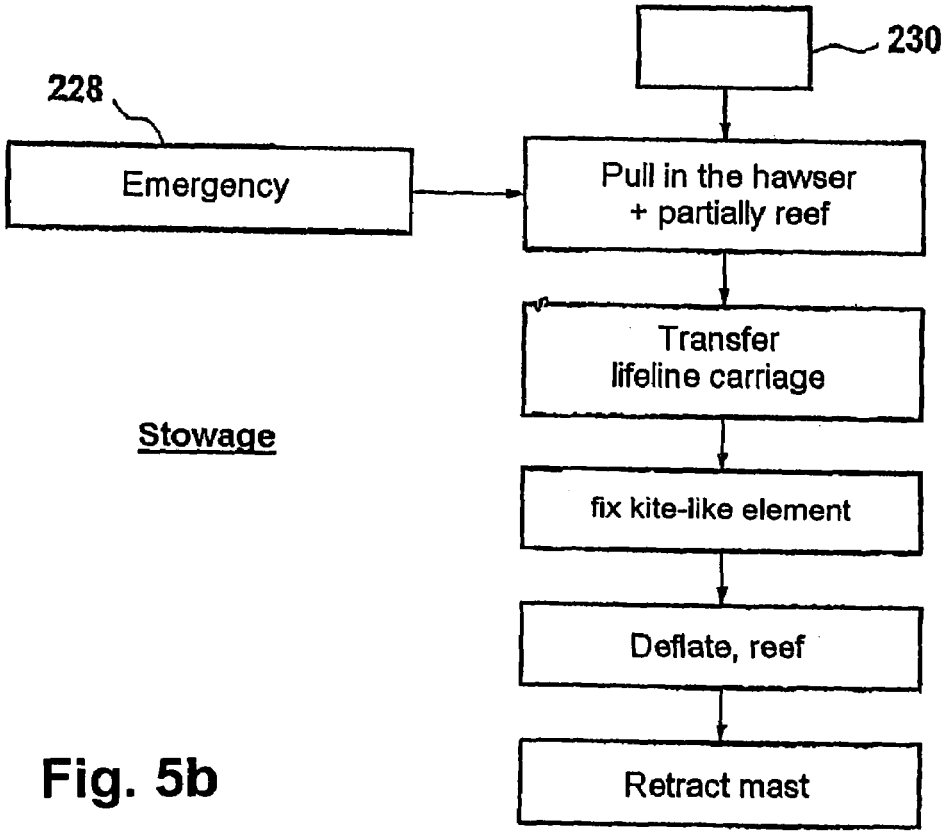
FIG. 5*b* shows a block diagram of a stowage process.

The block diagram illustrated in FIG. 5*b* shows a stowage process. This comprises the following sequence of individual processes: pulling in the hawser and partial reefing, I. transfer of the lifeline carriage, II. fixing of the kite-like element profile, III. deflation and reefing, IV. retraction of the crane and the kite-like element followed by folding up and packaging of the element on which the wind acts, as is also illustrated with the corresponding roman numerals in a corresponding manner to that in the figures shown in FIG. 6*b*. The sequence of actions is initiated in a corresponding manner by a control command from the block 230 in FIG. 3. In this case, it is also possible for a stowage process to be initiated in an emergency situation, in which case the block 228 would emit a signal. (The signal profile relating to the blocks 228 to 230 is illustrated in a simplified form in FIGS. 5*a* and 5*b*. In this case, the actual implementation may also include further logic signal links which ensure that the deployment and stowage functions are carried out safely, without any collision with other maneuvers).

A schematic illustration of the procedure for a deployment process will be described in detail once again with reference to FIG. 6*a*: the first phase is to prepare for extension of the crane and, if appropriate, to remove the tarpaulin or the like from the element on which the wind acts. The kite-like element is already located with the profile nose at the mast top. After complete extension, the air chamber starts to fill (in some circumstances also assisted by the fan), and partial unreefing starts. The element on which wind acts can now be aligned freely in the wind by means of the receptacle which can rotate.

As soon as the element on which wind acts has assumed its aerofoil profile, it is decoupled and falls off through about 15° in the leeward direction. The autopilot takes over the flight phase at this point, at the latest. The element on which wind acts is raised to the desired altitude by paying out the hawser, and is completely unreefed.

Figure 6B:
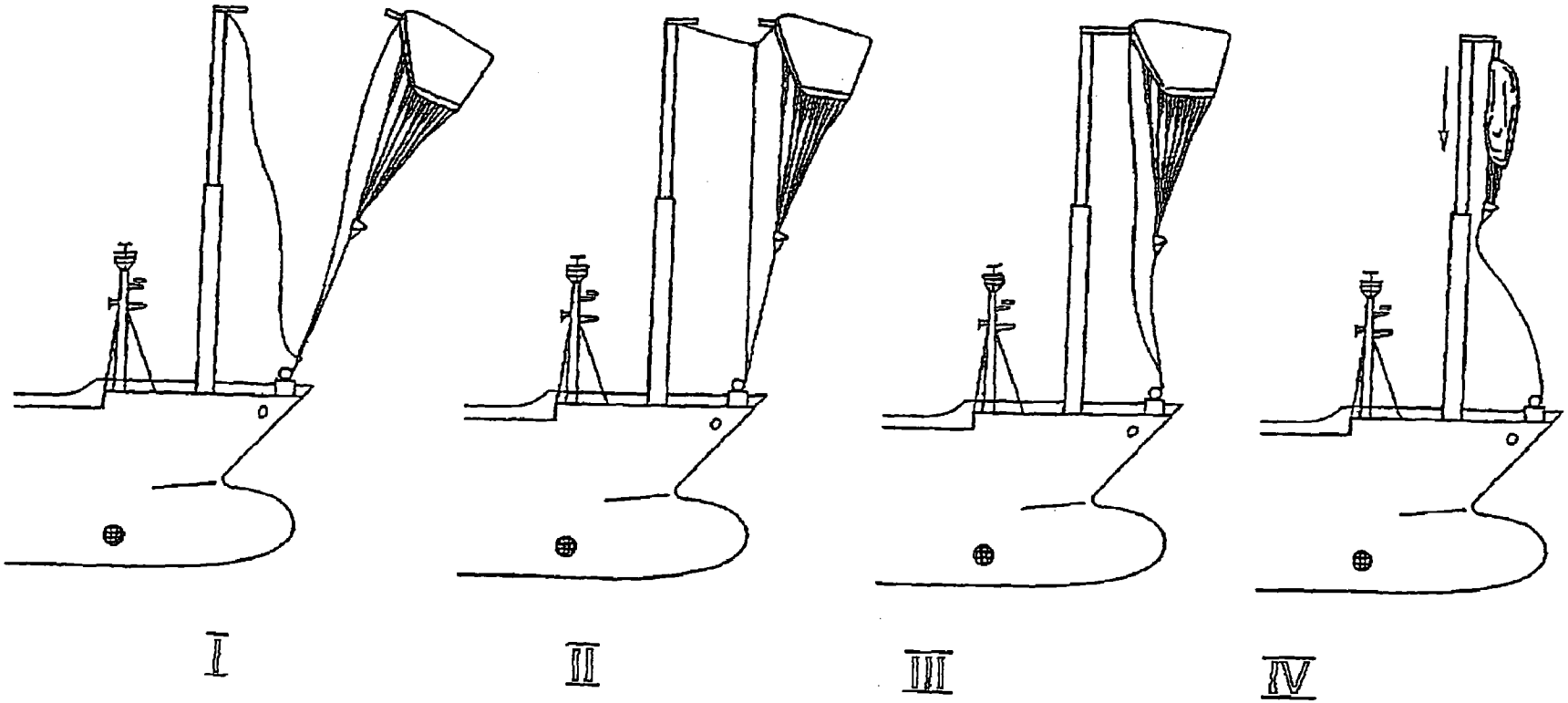
FIG. 6*b* shows a schematic illustration of the procedure for a stowage process.

FIG. 6*b* shows a schematic illustration of the procedure for a stowage process: the element on which wind acts is moved by pulling on the winch to an altitude which corresponds radially to the height of the crane. At the same time, the element on which wind acts is partially reefed. The lifeline is pulled in, having been parked on the bow in the vicinity of the winch during the flight phase, via the recovery point roller (which is not illustrated). A guide apparatus (or the like) slides up on the hawser from the recovery point roller to the profile nose and pulls the kite-like element, together with the gondola, in the windward direction towards the crane. The control gondola is also held on the mast here, and the flight phase ends. This fixed connection between the gondola and the mast allows a system check to be carried out on the control components. The kite-like element is then reefed uniformly on both sides, and the crane can be lowered.

I and II in FIG. 6*a* and IV in FIG. 6*b* show that the collapsed element on which wind acts hangs down loosely from the receptacle apparatus. This will be the case, of course, only if there is no wind. In the presence of wind, the collapsed element on which wind acts is aligned more or less horizontally, so that it offers only a small area for the wind to act on and does not exert a large pulling force on the crane.

The element on which wind acts is either guided with respect to the crane or the crane is guided with respect to the element on which wind acts, or a combination of both is used. The element on which wind acts is moved towards the receptacle apparatus or docking apparatus by means of suitable guide devices or by sensors, in order that an appropriate mechanism can complete the docking maneuver.

Figure 7:
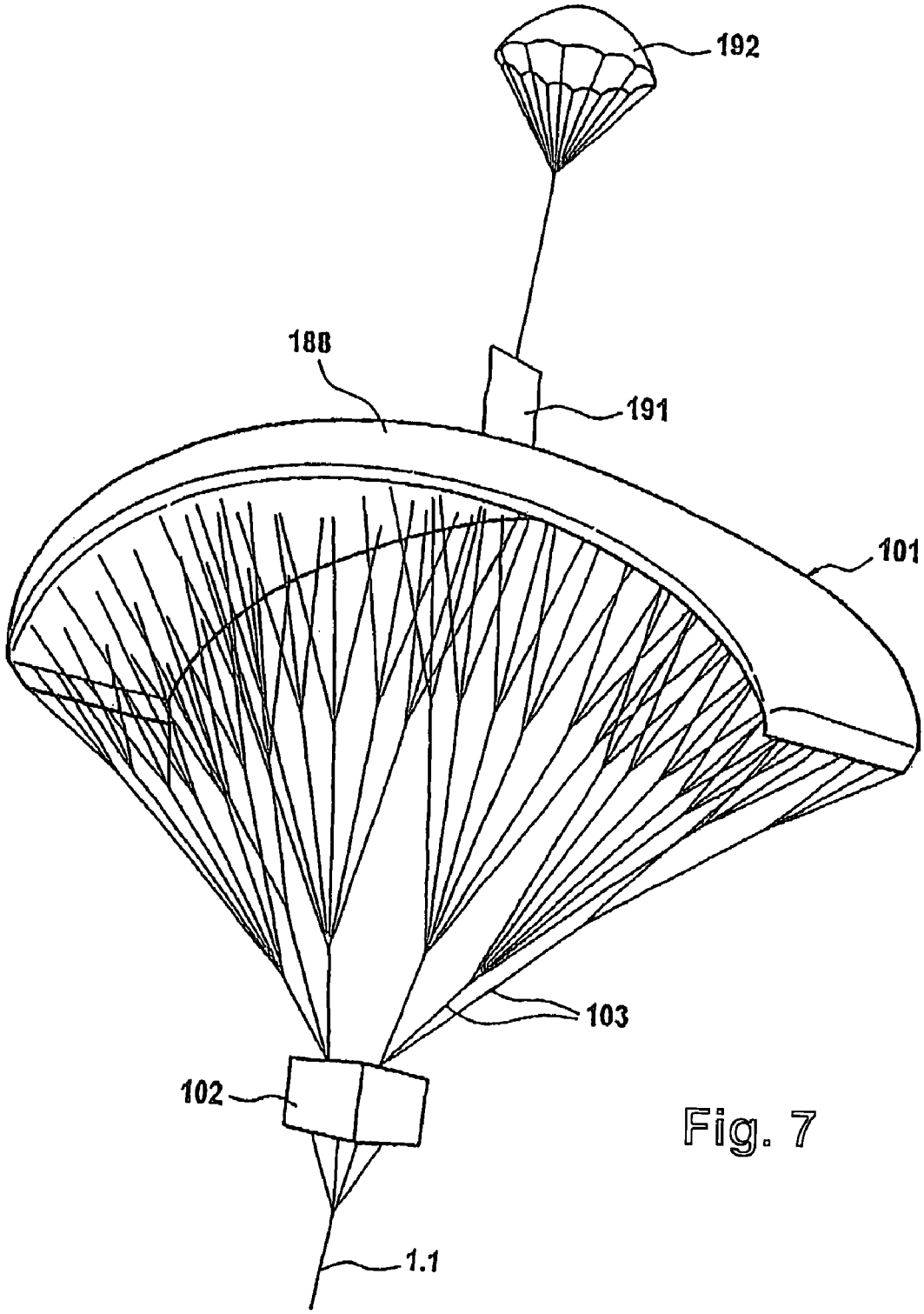
FIG. 7 shows a speeded-up stowage process.

FIG. 7 illustrates how a speeded-up stowage process can be achieved. In the embodiment variant illustrated here, an opening is provided, which is closed by means of Velcro strips or the like, can be torn open, is connected to the inflatable bellows 188, and whose cover 191 is connected to a parachute 192 which can be deployed. In response to an appropriate control command, the parachute 192 is deployed during the stowage process before docking on the element 181, and tears the cover 191 out, so that the pressurized air escapes quickly from the bellows 188.

This also makes it possible to initiate an emergency reefing process by rapidly opening the closure area (which closes off the inflatable element) of the cover 191. During this process, the reefing lines 169 and 170 are connected to the parachute 192. These reefing lines are quickly pulled together by the wind pressure in the parachute 192.

The invention is not necessarily linked to the illustrated exemplary embodiments. Other configurations which are within the scope of the invention result from combinations of dependent claims, which will be evident to a person skilled in the art on the basis of the above description.

The invention claimed is:

1. A deployment system for docking and deploying a freely flying kite element on which wind acts for propulsion of a watercraft in which the element on which wind acts and which has a wing profile is connected by a hawser to the watercraft, and the element on which wind acts can be moved from a rest position on-board the watercraft to a raised launch position from which the element is deployed, said system comprising:

a holder that can be raised and lowered; and a docking receptacle on said holder that can be pivoted in azimuth for moving the element on which wind acts to a position in which it is subject to sufficient wind effect to cause propulsion of the watercraft, said docking receptacle having a configuration to receive a portion of said element on which wind acts when said element is docked and into which a portion of the element on which the wind acts is drawn, wherein said hawser has a point where it spreads out into a number of holding cables, and further including a connecting cable between the hawser and the element on which wind acts and which spans the point at which the hawser spreads and a life line which originates from the docking receptacle and whose free end is operatively connected to said connecting cable when the element on which wind acts is being docked and is moveable along the connecting cable onto said hawser as said element on which wind acts is being deployed.

2. The deployment system as claimed in claim 1, further including a hawser guide, and wherein the launch position is arranged offset in the horizontal and/or vertical direction with respect to the location of the hawser guide when the element on which wind acts is deployed.

3. The deployment system as claimed in claim 1, wherein the connecting cable is connected to the hawser by a cable junction and the element on which wind acts is connected to said cable junction by a continuation of said hawser, said life line being connected to said hawser by a guide apparatus that is in the form of a cable slide that can move from a position on the hawser onto the connecting cable when the element on which wind acts is being docked.

4. The deployment system as claimed in claim 1, wherein the element on which wind acts exerts significantly less load in the vertical direction when docked than when not docked.

5. The deployment system as claimed in claim 3, wherein the cable junction has an essentially T-shaped profile, which is surrounded in an Ω-shape by the guide apparatus.

6. The deployment system as claimed in claim 1, wherein the docking receptacle, which can rotate in azimuth, has an apparatus in the form of a wind vane which automatically places the configuration of the docking receptacle into which the portion the element on which the wind acts is drawn on the lee side.

7. The deployment system as claimed in claim 1, further including a guide roller, which is attached eccentrically to the docking receptacle apparatus, for the lifeline.

8. The deployment system as claimed in claim 1, wherein the element on which wind acts is curved over the extent of its width.

9. The deployment system as claimed in claim 1, wherein the element on which wind acts is caught via an attachment which forms a point for which wind forces acting symmetrically on the element on which wind acts compensate vertically and horizontally.

10. The deployment system as claimed in claim 1, wherein the element on which wind acts has a reefing device for reefing said element, and the deployment and docking of the element on which wind acts take place when reefed.

11. The deployment system as claimed in claim 1, wherein the element on which wind acts has a fixed, unreefed center part.

12. The deployment system as claimed in claim 10, wherein said reefing device has pulling lines for causing the reefing of said element on which wind acts, and further including a motor for operating said pulling lines.

13. The deployment system as claimed in claim 10, wherein said wing profile has a side extension within which the reefing takes place.

14. The deployment system as claimed in claim 10, wherein folds are created during the reefing, said folds being wrapped in between areas with a fixed profile cross section.

15. The deployment system as claimed in claim 1, wherein an identical profile cross section is provided essentially over the entire length of said wing profile.

16. The deployment system as claimed in claim 1, wherein said wing profile includes a leading edge and areas of fixed wing cross section and further including at least one inflatable element provided in the area of the wing profile leading edge and/or between the areas with a fixed wing cross section, in order to increase stability.

17. The deployment system as claimed in claim 16, wherein the element on which wind acts has a hollow area and the inflatable element occupies the entire hollow area.

18. The deployment system as claimed in claim 16, further including a connecting element in said docking receptacle having a cross section through which a medium which enters or emerges from the inflatable element can pass.

19. The deployment system as claimed in claim 18, further including a fan operatively connected to the docking receptacle apparatus for filling or emptying the inflatable element.

20. The deployment system as claimed in claim 19, wherein said holder has a length and a hollow area which extends essentially over the length of the holder and is connected to the fan.

21. The deployment system as claimed in claim 10, further including a sensor element for providing an output signal in response to a condition and said element on which wind acts has an inflatable element, and wherein reefing can be initiated when the element on which wind acts is flying freely, by means of an output signal from said sensor element, to initiate the deflation of the inflatable element.

22. The deployment system as claimed in claim 16, further including a closure area closing said inflatable element whereby an emergency reefing process can be initiated by rapid opening of said closure area.

23. The deployment system as claimed in claim 22, further including a parachute that can be deployed as the hawser is pulled in quickly for rapid opening of said closure area for the emergency reefing process.

24. The deployment system as claimed in claim 1, wherein said holder constitutes a crane and the docking receptacle is arranged at the upper end of said crane.

25. The deployment system as claimed in claim 24, wherein said crane is telescopic with hydraulic cylinders being connected to adjacent or successive telescopic segments, for drive purposes.

26. The deployment system as claimed in claim 24, whereon said crane comprises a body which can be inflated by means of a compressed gas.

27. The deployment system as claimed in claim 26, wherein the compressed gas is compressed air.

28. The deployment system as claimed in claim 16, wherein said docking receptacle that can pivot in azimuth has a connecting element for compressed gas that can be connected to the inflatable element of the element on which wind acts.

29. The deployment system as claimed in claim 1, further comprising a controller for control of said element on which wind acts and wherein the docking of the element on which wind acts can be initiated automatically in the event of a malfunction of the controller.

* * * * *